US005899093A

United States Patent [19]

Ha

[11] Patent Number: 5,899,093

[45] Date of Patent: May 4, 1999

[54] PROCESS AND APPARATUS FOR THE PRODUCTION OF NITROGEN BY CRYOGENIC DISTILLATION

[75] Inventor: Bao Ha, San Ramon, Calif.

[73] Assignee: Air Liquide Process and Construction, Inc., Houston, Tex.

[21] Appl. No.: 09/083,570

[22] Filed: May 22, 1998

[51] Int. Cl.[6] ..... F25J 3/00

[52] U.S. Cl. ..... 62/643; 62/627

[58] Field of Search ..... 62/627, 643

[56] References Cited

U.S. PATENT DOCUMENTS

| | | | |
|---|---|---|---|
| 1,932,903 | 10/1933 | McKee | 62/627 |
| 5,257,505 | 11/1993 | Butts | 62/927 |
| 5,669,236 | 9/1997 | Billingham et al. | 62/643 |

*Primary Examiner*—Ronald Capossela
*Attorney, Agent, or Firm*—Linda K. Russell

[57] ABSTRACT

A single or double dephlegmator is used to transfer heat between condensing nitrogen and rich liquid in a single column nitrogen generator.

22 Claims, 4 Drawing Sheets

PROCESS AND APPARATUS FOR THE PRODUCTION OF NITROGEN BY CRYOGENIC DISTILLATION

BACKGROUND OF THE INVENTION

1. Field of the Invention

The present invention is related to a process and an apparatus for the production of nitrogen by cryogenic distillation.

2. Related Art

The production of nitrogen by cryogenic distillation is well known and is described in numerous patent publications (J53-122861; U.S. Pat. No. 5,144,809; U.S. Pat. No. 4,867,773; U.S. Pat. No. 5,385,024; U.S. Pat. No. 4,927,441; U.S. Pat. No. 4,848,996; U.S. Pat. No. 4,883,519; U.S. Pat. No. 4,872,893; U.S. Pat. No. 4,869,742; U.S. Pat. No. 5,711,167; U.S. Pat. No. 5,611,218; U.S. Pat. No. 5,582,034; U.S. Pat. No. 5,402,647; U.S. Pat. No. 4,883,519; U.S. Pat. No. 5,385,025, WO/PCT/IB96/00323), and "Production of Medium Pressure Nitrogen by Cryogenic Air Separation" *Gas Separation & Purification,* 1991 Vol. 5, December, pp. 203–209.

Over the years numerous efforts have been devoted to the improvement of this production technique to lower the nitrogen cost which consists mainly of the power consumption and the equipment cost. As a general rule, an efficient process usually requires an additional degree of complexity of the equipment and the resulting cost will be increased. Therefore there is a constant need to come up with an efficient and simple process to assure a good trade-off between power cost and equipment cost.

The new invention described below utilizes the dephlegmation technique in a sub-section of the process cycle to combine distillation column and heat exchanger into simple and compact plate-fin exchanger equipment. Significant cost reduction can be achieved and at the same time good efficiency of the overall process can be maintained.

Dephlegmation is used to promote simultaneous heat and mass transfers so that a heat exchange function and a distillation effect can be conducted simultaneously in a single heat exchanger. Reflux condensation is an application of dephlegmation where a gaseous mixture being separated by rectification is simultaneously heat exchanged with a fluid stream that is raised in temperature or is vaporized by the heat exchange and thereby condenses fluid being rectified to create a countercurrent reflux flow for the rectified stream. In similar fashion, stripping reboil is another aspect of dephlegmation where a liquid flowing down inside a heat exchanger exchanges heat with another stream resulting in a partial vaporization and a formation of a rising vapor. This rising vapor being in direct contact with the down flowing liquid provides the stripping effect.

Several dephlegmator processes in cryogenics are described in previous patents and text books:

U.S. Pat. No. 2,861,432; U.S. Pat. No. 2,963,872; U.S. Pat. No. 5,592,832; U.S. Pat. No. 5,694,790; U.S. Pat. No. 5,030,339; U.S. Pat. No. 5,144,809; U.S. Pat. No. 5,207,065; U.S. Pat. No. 5,410,855; U.S. Pat. No. 5,438,836; U.S. Pat. No. 5,592,832; U.S. Pat. No. 5,596,883; "The Physical Principles of Gas Liquefaction and Low Temperature Rectification" by Mansel Davies published 1949 pp. 137–139, "Zerlegung der Luft" by H. Hausen published 1957 p. 164 and "Separation of Gases" by Ruheman, $2^{nd}$ Edition, pp. 70, 174, 279–83, 291, 292.

The above publications address the application of dephlegmators in the production of oxygen, nitrogen, hydrogen, helium etc.

Nitrogen is widely used in the industry for inerting, blanketing, ammonia production and electronics. The required purity of nitrogen is usually in the ppm's of oxygen for most applications and in the sub-ppb's for electronics. In some cases lower purity (1% to 2% $O_2$ or 99% to 98% nitrogen) can be used.

The basic process for nitrogen production is shown in FIG. 1. This process is also called the classical process.

Air is compressed in a main air compressor 1 and then purified in 3 to remove water and carbon dioxide. It is cooled in heat exchanger 5 and sent to the bottom of column 9 where it separates into an oxygen enriched bottom fraction 12 and a nitrogen enriched top fraction. Part of the nitrogen enriched fraction is removed as liquid 19 at the top of the column. Nitrogen enriched gas is condensed in condenser 11 by heat exchange with expanded oxygen enriched liquid 12 (rich liquid) removed from the bottom of the column. The vaporized rich liquid 15 is warmed in the heat exchanger, expanded in turbine 7 to provide refrigeration for the process and is removed as waste after further warming. Gaseous nitrogen 17 is removed from the top of the column and is warmed in the heat exchanger.

U.S. Pat. No. 5,144,809 describes a process for nitrogen production wherein the column and exchangers are combined into a single plate fin exchanger. A portion of the medium air stream is subjected to dephlegmation to yield medium purity N2 (98–99%). This process provides low cost equipment but is limited to applications where the required purity is not stringent. Its power consumption is relatively high.

U.S. Pat. No. 4,867,773 and U.S. Pat. No. 4,966,002 describe a process similar to the classical process but a portion of the vaporized rich liquid extracted at the bottom of the distillation column is recompressed and recycled back to the distillation column or to the air stream feeding the distillation column. This arrangement allows some improvement over the classical process in terms of power consumption.

U.S. Pat. No. 4,848,996 adds a short column above the rich liquid vaporizer of the U.S. Pat. Nos. 4,867,773/4,966,002 process to yield a gaseous stream with similar composition to air (synthetic air). This stream is then recycled back to the air stream at an interstage of the air compressor to eliminate a separate recycle compressor.

U.S. Pat. No. 4,883,519 describes an improvement over the U.S. Pat. Nos. 4,867,773/4,966,002 process by partially vaporizing the rich liquid, recycling the resulting gaseous stream and expanding to lower pressure and vaporizing it in another exchanger.

U.S. Pat. No. 4,927,441 describes an improvement process over the U.S. Pat. No. 4,883,519 process by adding a short distillation column and distilling the bottom rich liquid of the high pressure column into a gaseous stream at lower pressure having a composition similar to air and a second liquid stream. The new gaseous "air" stream is recycled to an interstage of the main air compressor and recombined with the main air stream feeding the distillation column. This distillation column separates the feed into a nitrogen product stream at the top and a bottom rich liquid (rich in $O_2$). The second liquid stream is expanded to lower pressure and subsequently vaporized to yield the waste nitrogen stream. A portion of gaseous nitrogen stream at the top of the column is split into two portions: The first portion is condensed in an exchanger located at the bottom of the short column to provide necessary reboil for this column. The second portion of gaseous nitrogen is condensed in another exchanger to provide the required duty for the vaporization of second liquid stream.

As previously mentioned and illustrated in the above description of the evolution of the process cycle, an improvement of the efficiency of the process results in an additional complexity of the process and consequently an increase in capital cost.

SUMMARY OF THE INVENTION

According to the present invention, there is provided a process for the production of nitrogen by cryogenic distillation wherein:

a) feed air is compressed, purified to remove contaminants which freeze out at cryogenic temperatures and cooled;

b) cooled, compressed air is introduced into a distillation column wherein it separates into a fluid enriched in oxygen and a fluid enriched in nitrogen;

c) a first liquid enriched in oxygen is removed from the bottom of the column, expanded and sent to a stripping dephlegmator;

d) removing a second liquid enriched in oxygen and a third stream from said stripping dephlegmator;

e) at least partially vaporizing at least part of said second liquid in a vaporizer to produce a further stream;

f) sending said nitrogen enriched fluid from the column to a rectifying dephlegmator to produce a nitrogen product and a liquid, said rectifying dephlegmator exchanging heat with said stripping dephlegmator; and g) returning at least part of said liquid to the column as reflux.

According to further aspects of the invention, the process may optionally comprise:

sending at least part of said third stream back to the column;

mixing said third stream with feed air;

mixing said third stream with feed air upstream of said purification step;

sending said second liquid to a separator and sending liquid constituting at least part of said second liquid from said separator to said vaporizer;

sending fluid from said vaporizer to said separator; and removing gas from said separator and expanding said gas.

Said vaporizer, said rectifying dephlegmator and said stripping dephlegmator may be combined into a single plate fin heat exchanger.

According to a further aspect of the invention, there is provided a process for the production of nitrogen by cryogenic distillation wherein:

a) feed air is compressed, purified to remove contaminants which freeze out at cryogenic temperatures and cooled;

b) cooled compressed air is introduced into a distillation column wherein it separates into a fluid enriched in oxygen and a fluid enriched in nitrogen;

c) a first liquid enriched in oxygen is removed from the bottom of the column expanded and sent to a stripping dephlegmator;

d) removing a second liquid enriched in oxygen and a third stream from said stripping dephlegmator;

e) at least partially vaporizing at least part of said second liquid in a vaporizer to produce a further stream;

f) sending said nitrogen enriched fluid from the column to a condenser to produce a nitrogen product and a liquid, said condenser exchanging heat with said stripping dephlegmator; and g) returning at least part of said liquid to the column as reflux.

Further optional features of this aspect of the invention include:

sending at least part of said third stream back to the column;

mixing said third stream with feed air;

mixing said third stream with feed air upstream of said purification step;

sending said second liquid to a separator and sending liquid constituting at least part of said second liquid from said separator to said vaporizer;

sending fluid from said vaporizer to said separator; and removing gas from said separator and expanding said gas.

Said condenser, said stripping dephlegmator and said vaporizer may be combined in a single plate fin heat exchanger.

Said second liquid may be expanded prior to vaporization. Alternatively said second liquid is not expanded prior to vaporization in the case where the separator is at the same pressure as the stripping dephlegmator.

According to another aspect of the invention, there is provided an apparatus for the production of nitrogen by cryogenic distillation including:

a) a distillation column;

b) a heat exchanger;

c) means for compressing feed air and sending said feed air to said heat exchanger and subsequently to said column;

d) means for removing a first oxygen-enriched liquid from the bottom of said column;

e) a stripping dephlegmator;

f) a rectifying dephlegmator in thermal connection with said stripping dephlegmator;

g) a vaporizer in thermal connection with said rectifying dephlegmator;

h) means for sending said first liquid to said stripping dephlegmator;

i) means for removing a second oxygen enriched liquid and a third gas from said stripping dephlegmator;

j) means for sending at least part of said second oxygen enriched liquid to said vaporizer;

k) means for removing a fluid from said vaporizer;

l) means for sending a nitrogen enriched gas to said rectifying dephlegmator; and m) means for sending a liquid from said rectifying dephlegmator to said column and means for removing a nitrogen enriched product gas from said rectifying dephlegmator.

According to a still further aspect of the invention, there is provided an apparatus for the production of nitrogen by cryogenic distillation including:

a) a distillation column;

b) a heat exchanger;

c) means for compressing feed air and sending said feed air to said heat exchanger and subsequently to said column;

d) means for removing a first oxygen-enriched liquid from the bottom of said column;

e) a stripping dephlegmator;

f) a condenser in thermal connection with said stripping dephlegmator;

g) a vaporizer in thermal connection with said condenser;

h) means for sending said first liquid to said stripping dephlegmator;

i) means for removing a second oxygen enriched liquid and a third gas from said stripping dephlegmator;

j) means for sending at least part of said second oxygen enriched liquid to said vaporizer;

k) means for removing a fluid from said vaporizer;

l) means for sending a nitrogen enriched gas to said condenser; and m) means for sending a liquid from said condenser to said column and means for removing a nitrogen enriched product gas from said condenser.

The new invention provides a simpler set of equipment and maintains the thermodynamic efficiency of the cycle. A dual dephlegmator (i.e. rectification dephlegmator and stripping dephlegmator) or a simple dephlegmator may be used to replace the top condenser of the column of the classical cycle.

DETAILED DESCRIPTION OF THE INVENTION

Figure 2:
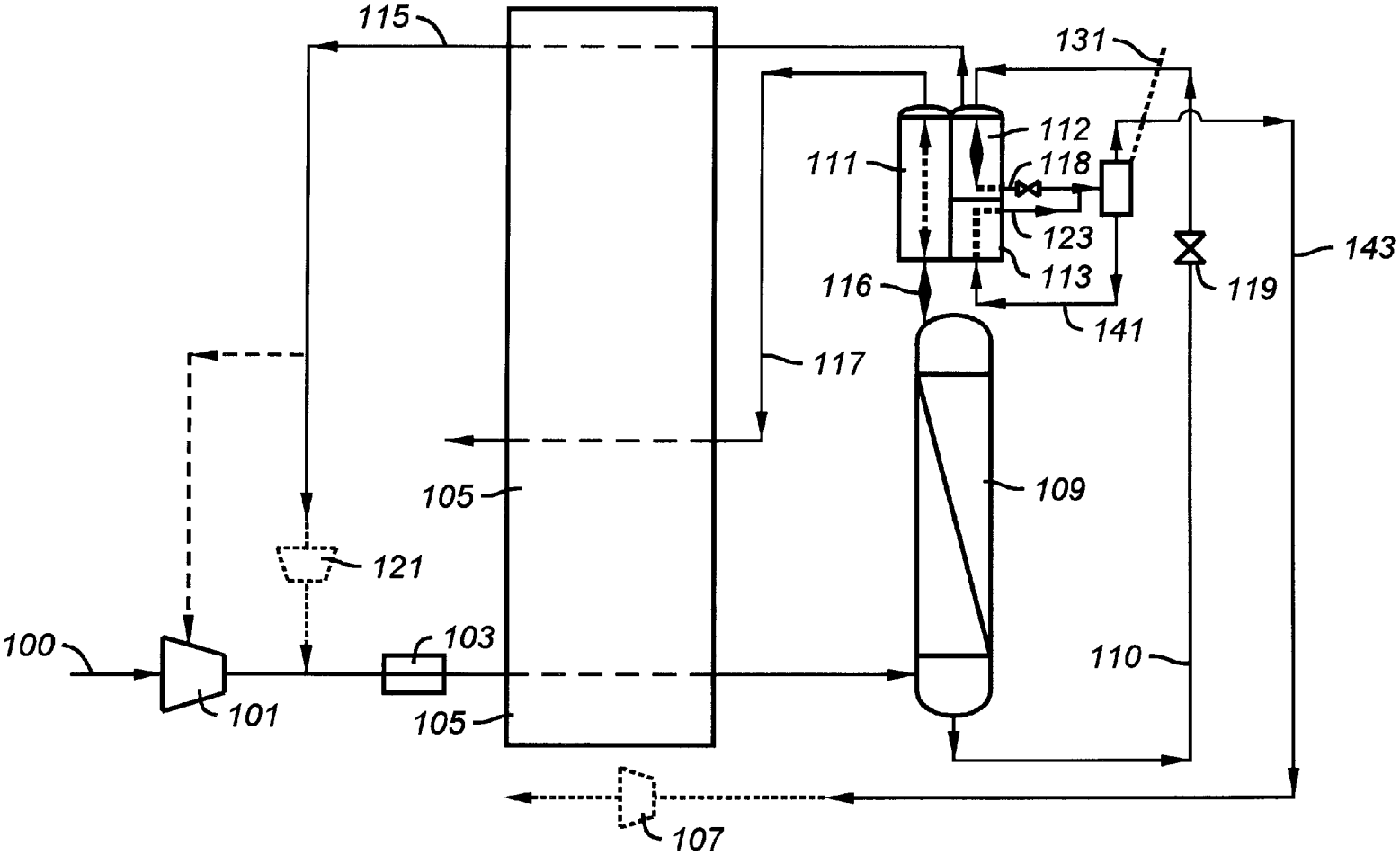
FIGS. 2, 3, and 4 illustrate three methods and apparatus for the production of nitrogen according to the present invention.

In FIG. 2, atmospheric air 100 is compressed in the main air compressor 101 and mixed with a recycled stream 115 extracted from the process. The mixing preferably takes place before or after the front end purification unit 103 where moisture and $CO_2$ in atmospheric air are removed to avoid freezing in downstream cryogenic equipment. The compression of the recycle stream is preferably performed in an independent compressor 121 or in a portion of the main air compressor 101 (as shown in dotted lines). In the latter arrangement the recycled stream is mixed at an interstage of the main air compressor.

FIG. 2 illustrates this process: the combined air stream is cooled in heat exchanger 105 and fed to the distillation column 109 to yield a nitrogen rich stream at the top and a first liquid stream rich in oxygen at the bottom. The first liquid 110 is then expanded to a lower pressure in valve 109 into the stripping dephlegmator 112 containing three theoretical trays and in thermal communication with nitrogen condensing nitrogen at the top of the column 109.

In the stripping dephlegmator 112 the down-flowing rich liquid exchanges heat with the condensing nitrogen rich stream in rectifying dephlegmator 111 yielding a rising vapor which in turn strips the down-flowing liquid and produces a third nitrogen rich overhead stream 115. A second liquid 118 (richer in oxygen than the first liquid 110) exits the stripping dephlegmator at the bottom. The second liquid is then expanded to lower pressure into a separator or receiver 131. The liquid 141 of the receiver is at least partially vaporized in the waste vaporizer 113 by heat exchange with the rectifying dephlegmator 11 to yield a gaseous stream 123 which is mixed with stream 118, sent to separator 131, and removed as waste stream 143.

The recycled nitrogen rich stream 115 is preferably further compressed in compressor 121 and mixed with the air stream feeding the column. This compression can be performed either at ambient temperature or cryogenic temperature (e.g. downstream of heat exchanger 105).

The embodiment of FIG. 2 also illustrates a rectifying dephlegmator on the condensing side. This arrangement is sometimes called double-dephlegmator wherein the stripping side is in thermal communication with the rectifying side. The nitrogen rich gas 116 at the top of the distillation column 109 enters the rectifying dephlegmator where it exchanges heat with the vaporizing rich liquid of the waste vaporizer and the stripping side yielding a condensate liquid flowing down in counter-current with the rising nitrogen rich stream. This down-flowing condensate rectifies the rising nitrogen rich gas and produces a richer nitrogen gaseous stream at the top of the rectifying dephlegmator 111 and a liquid reflux stream at the bottom. At least a portion of this liquid reflux is preferably returned to the top of the distillation column to serve as a reflux stream for distillation (also shown as stream 116 for simplicity). The richer nitrogen gaseous stream is preferably recovered as nitrogen product. The rectifying dephlegmator preferably contains three theoretical trays.

Light components such as Neon, Helium and Hydrogen (also called non-condensables) are present in the feed air and will be concentrated in this richer gaseous stream. If high concentration of non-condensables is undesirable then the nitrogen product can be extracted at the top or near the top of the distillation column and the richer nitrogen gaseous stream becomes a non-condensable stream. This stream is usually vented or rejected along with the gaseous waste stream. 143.

The gaseous waste stream 143 is preferably expanded in an expander 107 to provide the needed refrigeration for the process. This expander may be coupled to the compressor 121. Alternatively, liquid assist refrigeration may also be used in place of or in combination with the expander.

In the embodiment of FIG. 2 the waste vaporizer 113, the rectifying dephlegmator 111 and the stripping dephlegmator 112 are combined into one single plate fin exchanger.

The stream summary of the embodiment of FIG. 2 is given in Table 1. Composition of stream 100 is on a dry and $CO_2$ free basis.

TABLE 1

| STREAM NUMBER | PRESSURE (bar) | FLOW ($Nm_3/h$) | COMPOSITION (MOLE %) $N_2$ | Ar | $O_2$ |
|---|---|---|---|---|---|
| 100 | 1.01 | 1000 | 78.11 | 0.93 | 20.96 |
| 115 | 4.14 | 752.8 | 71.75 | 1.76 | 26.49 |
| 110 | 8.89 | 1069.2 | 59.65 | 2.10 | 38.25 |
| 117 | 8.70 | 683.6 | 99.98 | 0.02 | 3 vpm |
| 143 | 3.36 | 316.4 | 30.85 | 2.90 | 66.25 |

Figure 1:
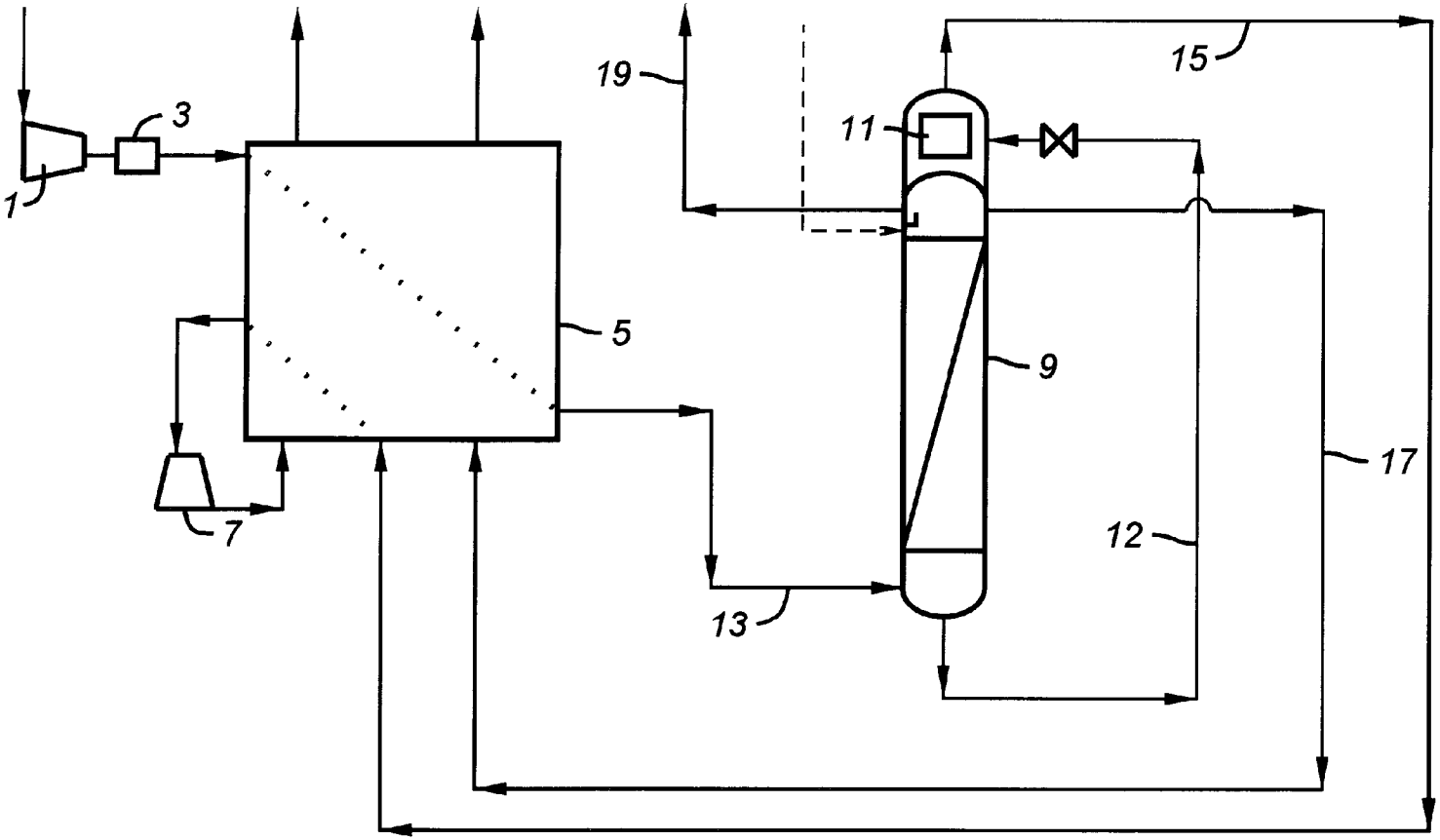
FIG. 1 is a schematic view of a prior art process for nitrogen production.

A comparison of the processes of FIG. 1 and FIG. 2 is shown in Table 2.

TABLE 2

| | FIG. 2 | FIG. 1 |
|---|---|---|
| Net feed flow ($Nm^3/h$) | 1000 | 1750 |
| Feed pressure (bar) | 9.04 | 9.04 |
| Recycle flow ($Nm^3/h$) | 752.8 | 0 |

TABLE 2-continued

| | FIG. 2 | FIG. 1 |
|---|---|---|
| Recycle pressure (bar) | 4.14 | n/a |
| Recycle outlet pressure (bar) | 9.04 | n/a |
| Nitrogen flow ($Nm^3/h$) | 684 | 684 |
| Nitrogen purity | 3 ppm oxygen | 3 ppm oxygen |
| Theoretical trays in column | 40 | 40 |
| Nitrogen pressure (bar) | 8.55 | 8.55 |
| Relative power | 72.7 | 100 |

The power gain of the FIG. 2 process is about 27%.

Figure 3:
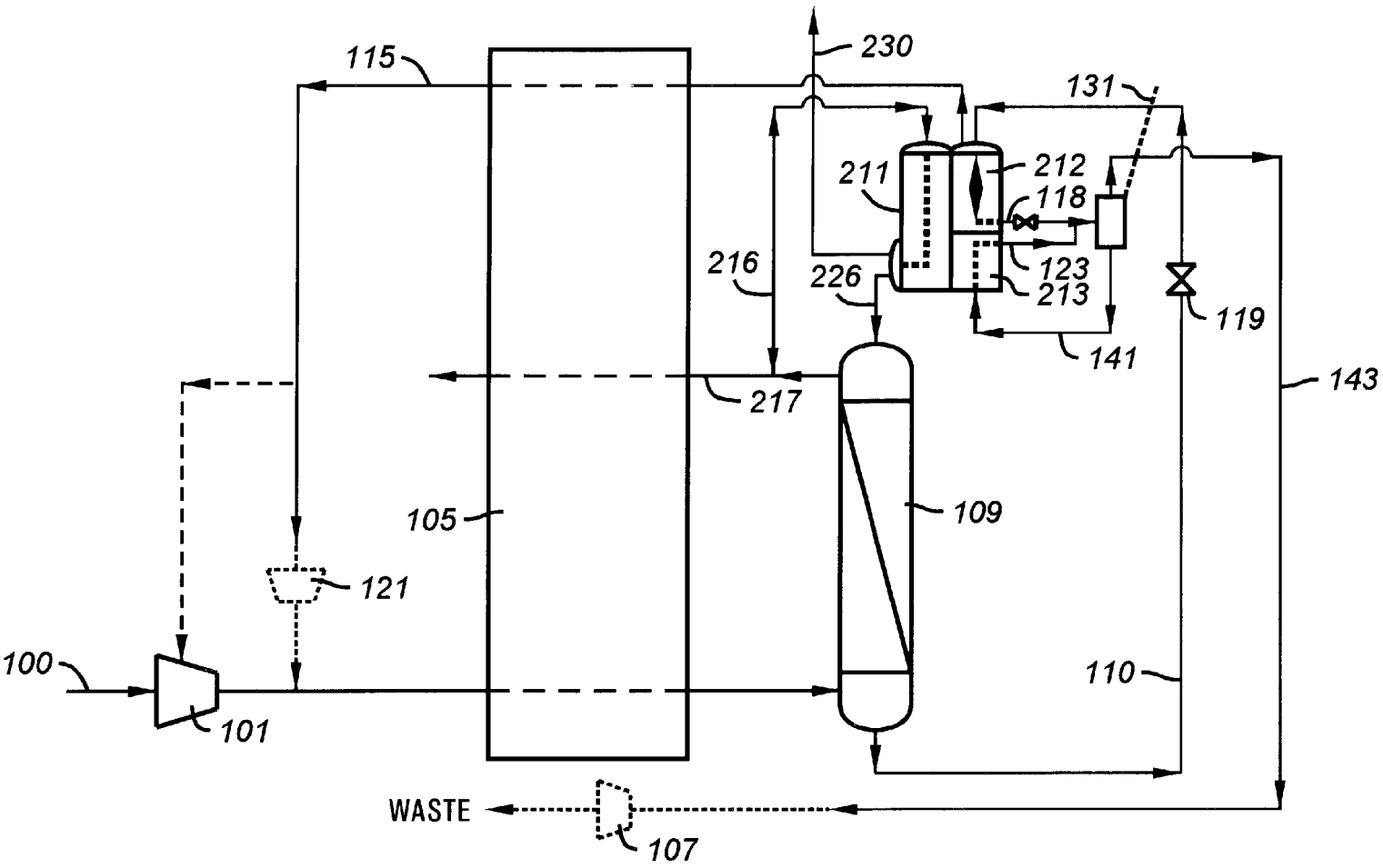

The embodiment illustrated in FIG. 3 illustrates the case where the condensing nitrogen side is not a rectifying dephlegmator. The condensing side is a nitrogen condenser 211 in this arrangement. The stripping dephlegmator 212 with three theoretical trays exchanges heat with the condensing nitrogen and no dephlegmation takes place on the nitrogen side. This embodiment produces nitrogen having a lower purity than that produced by the process of FIG. 2 because the nitrogen is not rectified following removal from the column.

Gaseous nitrogen is removed from the top of the column 209 and is separated into stream 217 and stream 216. Stream 216 is sent to the top of nitrogen condenser 211 and the condensed nitrogen 226 is sent back to the column as reflux.

In FIG. 3 the nitrogen condenser 211, the waste vaporizer 213 and the stripping dephlegmator 212 are combined into one single plate fin exchanger.

If high concentration of non-condensables is undesirable then the nitrogen product is preferably extracted at the top or near the top of the distillation column and the richer nitrogen gaseous stream becomes a non-condensable stream. This stream is usually vented via conduit 230 or rejected along with the gaseous waste stream. Alternatively, liquid assist refrigeration may also be used.

Figure 4:
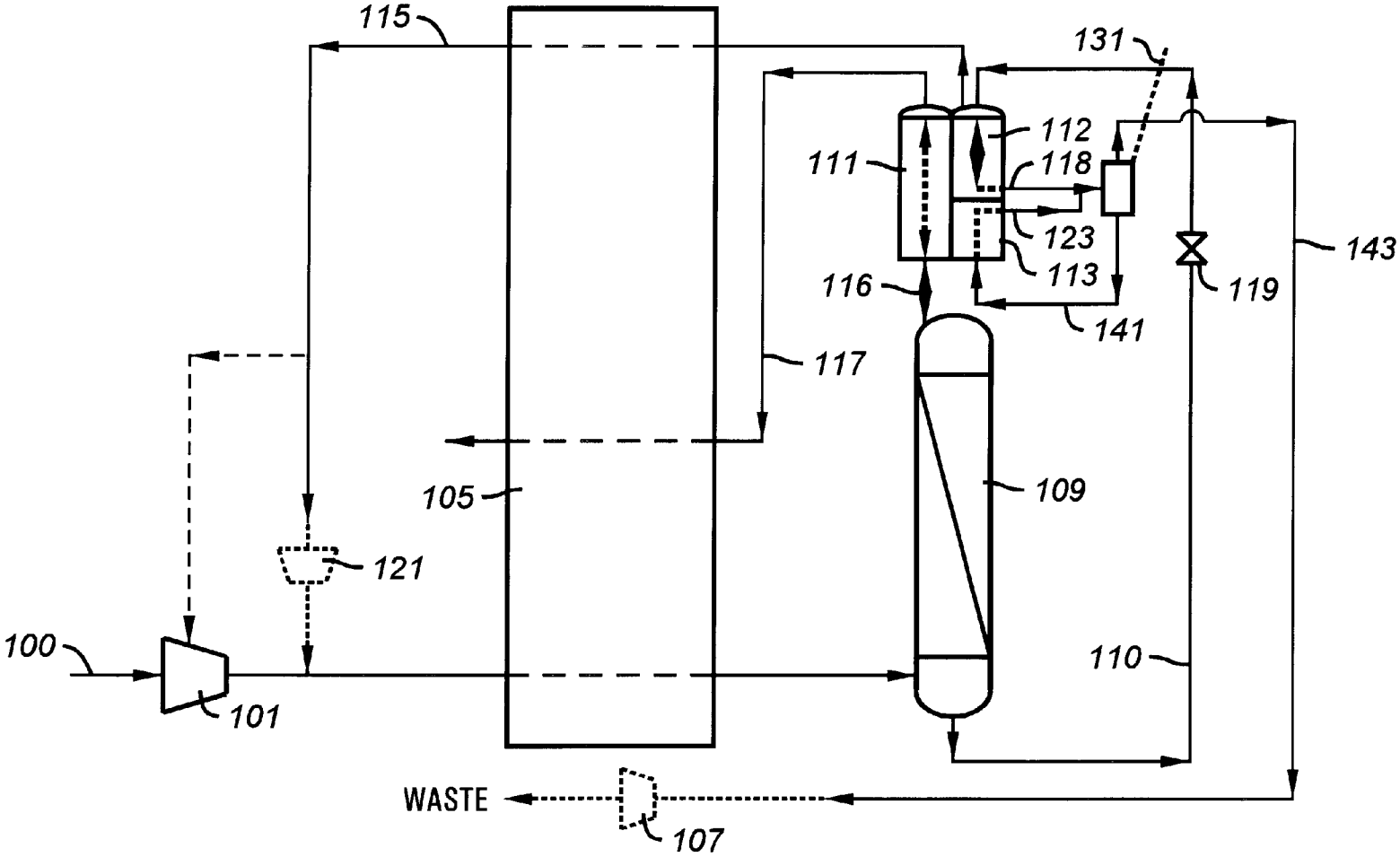

In FIG. 4, a double dephlegmator is used and the second rich liquid is sent to the separator/receiver 131 at essentially the same pressure as the stripping dephlegmator: the vaporized gaseous waste stream is then available at substantially the same pressure as the recycle stream. Of course this feature can be applied to the arrangement shown in FIG. 3, as well.

Although the above disclosure describes the use of plate fin exchanger for dephlegmators, it should be understood the invention would cover processes and apparati using any type of equipment promoting simultaneous heat and mass transfer on the vapor and liquid phases of an internal fluid and therefore yielding a stripping or rectifying effect on this fluid. Heat is removed or injected to the fluid undergoing dephlegmation by at least another fluid which itself is either subjected to dephlegmation (double dephlegmator) or simply is a heating or cooling stream.

In addition to the streams cited above (stripping, rectifying, heating or cooling) a dephlegmator can contain other additional process streams.

The process can be used to produce medium purity, high purity, or ultra-high purity nitrogen.

In some other variants, instead of mixing the recycled stream 115 with the air stream 100, one can opt to inject this stream directly into the column 109 at a feed tray location different from the main air feed.

The processes and apparatus of FIGS. 2, 3 and 4 may of course be used to produce liquid nitrogen if sufficient refrigeration is available.

Although FIGS. 2, 3 and 4 illustrate the waste vaporizer being in thermal communication first with the rectifying dephlegmator, it is possible to arrange the equipment to have the rectifying dephlegmator exchanging heat first with the stripping dephlegmator then with the waste vaporizer.

Optionally, the second oxygen enriched liquid leaving the stripping dephlegmator can be sent to another auxiliary receiver (not shown) before being expanded to the above described receiver 131 via the expansion valve. In this situation the expanded liquid can be controlled by simply monitoring the liquid level of the auxiliary receiver. The liquid collector header of the plate fin stripping dephlegmator can be used as auxiliary receiver if another vessel is not desirable.

One can also opt not to combine the waste vaporizer with the dephlegmator. In this arrangement the waste vaporizer is a separate heat exchanger in which the vaporization of the waste stream is achieved by heat exchange with condensing nitrogen gas extracted from or near the top of the column.

The column may contain any standard packing material e.g. trays, structured packing.

Although the above description refers to various embodiments, it is understood the present invention is nevertheless not intended to be limited to the details shown. Rather those skilled in the art will recognize that there are many other embodiments of the present invention within the scope of the claims.

What is claimed is:

1. A process for the production of nitrogen by cryogenic distillation wherein:

a) feed air is compressed and purified to remove contaminants which freeze out at cryogenic temperatures and cooled;

b) cooled compressed air is introduced into a distillation column wherein it separates into a fluid enriched in oxygen and a fluid enriched in nitrogen;

c) a first liquid enriched in oxygen is removed from the bottom of the column, expanded and sent to a stripping dephlegmator;

d) removing a second liquid enriched in oxygen and a third stream from said stipping dephlegmator;

e) at least partially vaporizing at least part of said second liquid in a vaporizer to produce a waste stream;

f) sending said nitrogen enriched fluid from the column to a rectifying dephlegmator to produce a nitrogen product and a liquid, said rectifying dephlegmator exchanging heat with said stripping dephlegmator; and g) returning at least part of said liquid to the column as reflux.

2. The process of claim 1 comprising sending at least part of said third stream back to the column.

3. The process of claim 2 comprising mixing said third stream with feed air.

4. The process of claim 3 comprising mixing said third stream with feed air upstream of said purification step.

5. The process of claim 1 wherein said vaporizer, said rectifying dephlegmator, and said stripping dephlegmator are combined into a single plate fin heat exchanger.

6. The process of claim 1 wherein said second liquid is expanded prior to vaporization.

7. The process of claim 1 wherein said second liquid is not expanded prior to vaporization.

8. The process of claim 1 including sending said second liquid to a separator and sending liquid from said separator to said vaporizer.

9. The process of claim 8 including sending fluid from said vaporizer to said separator.

10. The process of claim 8 including removing gas from said separator and expanding said gas.

11. A process for the production of nitrogen by cryogenic distillation wherein:

a) feed air is compressed and purified to remove contaminants which freeze out at cryogenic temperatures and cooled;

b) cooled compressed air is introduced into a distillation column wherein it separates into a fluid enriched in oxygen and a fluid enriched in nitrogen;

c) a first liquid enriched in oxygen is removed from the bottom of the column, expanded and sent to a stripping dephlegmator;

d) removing a second liquid enriched in oxygen and a third stream from said stripping dephlegmator;

e) at least partially vaporizing at least part of said second liquid in a vaporizer to produce a waste stream;

f) sending said nitrogen enriched fluid from the column to a condenser to produce a nitrogen product and a liquid, said condenser exchanging heat with said stripping dephlegmator; and g) returning at least part of said liquid to the column as reflux.

12. The process of claim 11 comprising sending at least part of said third stream back to the column.

13. The process of claim 11 comprising mixing said third stream with feed air.

14. The process of claim 13 comprising mixing said third stream with feed air upstream of said purification step.

15. The process of claim 11 wherein said condenser, said stripping dephlegmator, and said vaporizer are combined in a single plate fin heat exchanger.

16. The process of claim 11 wherein said second liquid is expanded prior to vaporization.

17. The process of claim 11 wherein said second liquid is not expanded prior to vaporization.

18. The process of claim 11 including sending said second liquid to a separator and sending liquid from said separator to said vaporizer.

19. The process of claim 18 including sending fluid from said vaporizer to said separator.

20. The process of claim 18 including removing gas from said separator and expanding said gas.

21. An installation for the production of nitrogen by cryogenic distillation including:

a) a distillation column having a column bottom;

b) a heat exchanger;

c) a compression unit, said compression unit adapted to compress feed air and send said feed air to said heat exchanger and subsequently to said distillation column;

d) a conduit adapted to remove a first oxygen-enriched liquid from the bottom of said column e) a stripping dephlegmator;

f) a rectifying dephlegmator in thermal connection with said stripping dephlegmator;

g) a vaporizer in thermal connection with said rectifying dephlegmator;

h) a conduit adapted to send said first liquid to said stripping dephlegmator;

i) a conduit adapted to remove a second oxygen enriched liquid and a third gas from said stripping dephlegmator;

j) a conduit adapted to send at least part of said second oxygen enriched liquid to said vaporizer;

k) a conduit adapted to remove a fluid from said vaporizer;

l) a conduit adapted to send a nitrogen enriched gas to said rectifying dephlegmator; and m) a conduit adapted to send a liquid from said rectifying dephlegmator to said column and a conduit adapted to remove a nitrogen enriched product gas from said rectifying dephlegmator.

22. An installation for the production of nitrogen by cryogenic distillation including:

a) a distillation column;

b) a heat exchanger;

c) a compression unit, said compression unit adapted to compress feed air and send said feed air to said heat exchanger and subsequently to said column;

d) a conduit adapted to remove a first oxygen-enriched liquid from the bottom of said column;

e) a stripping dephlegmator;

f) a condenser in thermal connection with said stripping dephlegmator;

g) a vaporizer in thermal connection with said condenser;

h) a conduit adapted to send said first liquid to said stripping dephlegmator;

i) a conduit adapted to remove a second oxygen enriched liquid and a third gas from said stripping dephlegmator;

j) a conduit adapted to send at least part of said second oxygen enriched liquid to said vaporizer;

k) a conduit adapted to remove a fluid from said vaporizer;

l) a conduit adapted to send a nitrogen enriched gas to said condenser; and m) a conduit adapted to send a liquid from said condenser to said column and a conduit adapted to remove a nitrogen enriched product gas from said condenser.

* * * * *